United States Patent [19]

Schmale

[11] 4,403,694

[45] Sep. 13, 1983

[54] GUIDE STRIP FOR CONVEYING FITTINGS INTO A STUDDING MACHINE

[75] Inventor: Karl E. Schmale, Lüdenscheid, Fed. Rep. of Germany

[73] Assignee: Schmale & Co., Lüdenscheid, Fed. Rep. of Germany

[21] Appl. No.: 193,387

[22] Filed: Oct. 2, 1980

Related U.S. Application Data

[63] Continuation of Ser. No. 865,597, Dec. 28, 1977, abandoned.

[30] Foreign Application Priority Data

Dec. 28, 1976 [DE] Fed. Rep. of Germany ..... 2659150

[51] Int. Cl.[3] ..... B65D 85/24

[52] U.S. Cl. ..... 206/347; 221/74; 411/442; 411/466

[58] Field of Search ..... 206/345, 346, 347; 411/442–444, 461, 462, 466; 221/25, 70, 71, 74; 29/432

[56] References Cited

U.S. PATENT DOCUMENTS

| | | | |
|---|---|---|---|
| 3,211,284 | 10/1965 | Anstett | 206/346 |
| 3,342,327 | 9/1967 | Newton | 206/346 |
| 4,018,334 | 4/1977 | Lejdegard | 206/346 |

*Primary Examiner*—Stephen P. Garbe

*Attorney, Agent, or Firm*—Spencer & Kaye

[57] ABSTRACT

A guide strip for holding a succession of fittings which are to be hammered into box-shaped containers in a studding machine and for conveying such fittings into the machine, the strip being constituted by a tape-like foil presenting a succession of nests for holding such fittings.

11 Claims, 4 Drawing Figures

GUIDE STRIP FOR CONVEYING FITTINGS INTO A STUDDING MACHINE

CROSS-REFERENCE TO RELATED APPLICATION

This application is a continuation of Application Ser. No. 865,597, filed Dec. 28th, 1977 now abandoned.

BACKGROUND OF THE INVENTION

The present invention relates to a guide strip equipped with fittings, or hardware, for a studding machine which operates to hammer the fittings individually onto a box-shaped container.

Such guide strips serve to simplify the supplying and attachment of fittings to box-shaped containers, such as wooden boxes, cardboard boxes, luggage, or cases of wood, leather, cardboard, plastic or the like. The guide strip to which the fittings are fastened eliminates the necessity of having to arrange the individual fittings for introduction into the studding tool of the studding machine and the separate insertion of individual fittings into the studding tool. Instead, such a strip permits use of a tape-like supply, e.g. from a roll. Within the studding machine, the fittings are separated from the guide strips and attached to the box-shaped container. The tape-like supply accelerates and economizes the attachment process.

Guide strips are known which form an integral unit of material with the fittings, as described in German Auslegeschrift [Published Patent Application] No. 19 10 580, as are strips which are provided with amounts for positively and securely fastening each one of the fittings, the latter being disclosed in German Offenlegungsschrift [Laid-open Application] No. 25 12 877. The present invention relates to a guide strip of the latter type.

SUMMARY OF THE INVENTION

It is an object of the invention to simplify the design of such guide strips and their mounts for securing the fittings. According to the invention, this is accomplished by providing nests in a tape-like foil in which the fittings are seated.

In the practice of the present invention, the dimensions and the arrangement of the nests in the guide strip are selected on the basis of the particular dimensions of the fitting. For fittings with different dimensions, the nests are arranged differently. The guide strips according to the invention make possible the use of a studding machine for the attachment of fittings of types which previously could not be attached in a guide strip, or which could be attached only with difficulty. For example, the invention permits attachment, by means of a studding machine, of closure devices, such as one or two piece locks, as well as hinges, handles, corners or other connections having different dimensions.

In structures according to the invention, the guide strips and the fitting form independent units. The fittings are brought to the studding tool in the nests, are released from the nests in the tool and are attached to the container. After passage through the tool, the guide strip can be reused to accommodate fittings having substantially coinciding dimensions.

The guide strip is thus a holding and transporting device. As required, it can be used as an advancing or delaying device in the form of a strip or roll. The guide strip assures that the fittings will be fed in in a positive and synchronous manner. Up to the moment that the fittings are introduced into a studding machine, the guide strip simultaneously serves as a packaging element.

To simplify manufacture of the guide strip, it is of advantage if each of the nests therein is conically tapered and is provided with a mount for the fitting. Special mounts are not required for the guide strip according to the invention. Rather the mount may be made of the foil material, and formed out of the foil strip. For example, to accomplish this, at least two tabs, or fingers, can be provided in the edge region of each nest, or each nest can have associated with it a tongue which in part covers the fitting which is to be inserted. It is also possible to attach the fitting weakly to the bottom of the nest by means of an adhesive. In any case, the fitting can easily be removed from the nest in the studding machine.

According to a further embodiment of the invention, spacers are provided in a plane perpendicular to the plane formed by the foil. This embodiment permits the guide strips to be wound into a roll without parts of the fittings, particularly bent-over pin-like points, being tangled in the preceding layer of the roll during winding and thus scratching the fittings. In this connection, it is of advantage, from a manufacturing point of view, to provide in the foil, on the side of the nests, hollow protrusions in the form of a truncated pyramid. In this embodiment the nests can be formed in the foil in the same manufacturing process as the spacers.

The spacers can simultaneously serve as engagement means for advancing and/or aligning devices in the studding machine. It is also possible to provide the foil, at selected intervals, with deformations for the engagement of the advancing and/or alignment devices of the studding machine. The deformations assure dependable supply and guidance of the guide strip. The special deformations may be protrusions, e.g. nubs, as well as recesses, e.g. holes.

The material for the guide trip is freely selectable within limits. For example, foils of cardboard, metal or plastic can be used. Preferably, the nests, the spacers and the deformations are produced in the plastic foil by a deep drawing process.

If the foil of which the guide strip is made is sufficiently thin, which is the case, for example, if polyvinyl chloride, which is a preferred material, is employed, the fitting can be removed from the guide strip through the foil and can be hammered into the box-shaped container. For thicker foils it is preferable to provide holes in the bottoms of the nests. In that case, the studding hammers of the studding tool pass through the holes and thus act on the fitting. Guide strips according to the invention can be easily manufactured and can be equipped with fittings of almost any desired type without any danger of an accident, can be stored and transported without any danger of damaging the fittings, and, finally, can be introduced quickly and dependably into a studding machine where the fitting is released from the guide strip and is hammered onto the box-shaped container in the conventional manner.

DESCRIPTION OF THE PREFERRED EMBODIMENTS

Figure 3:
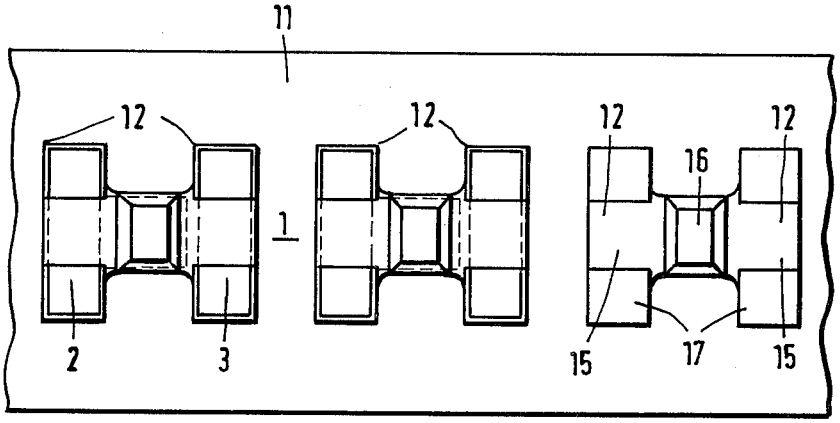
FIG. 3 is a bottom plan view of the article shown in FIG. 1.
Figure 2:
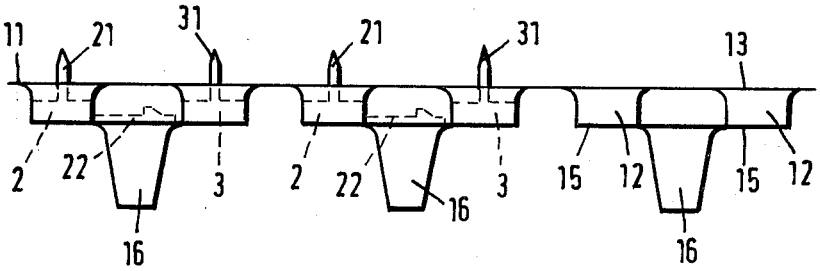
FIG. 2 is a side elevational view of the article shown in FIG. 1.
Figure 1:
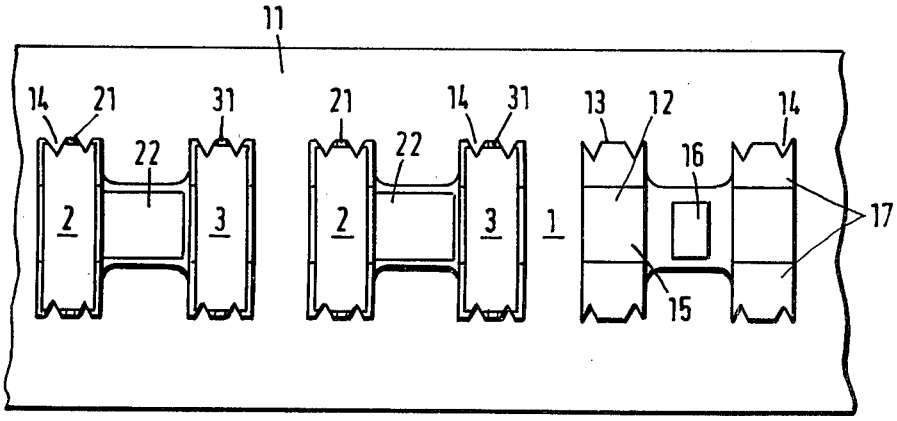
FIG. 1 is a top plan view of a selected preferred embodiment of the invention.

FIGS. 1–3 illustrate a guide strip 1 for introducing locks or catches, each composed of a latch portion 2 and a recess portion 3, into a studding machine, which is not illustrated.

The guide strip 1 is constituted by a tape-like foil 11 in which pairs of nests 12 are formed. Each nest has its outlines adapted to the outlines of a respective portion 2 or 3 of a catch and each nest 12 is conically tapered toward the bottom. Each Figure shows three pairs of nests each arranged to hold the portions 2 and 3 of a respective catch. The central and left-hand pairs of nests carry the portions of a catch, while the right-hand pair of nests is empty.

Along each narrow edge 13 of each nest 12, special holding means in the form of two tabs, or fingers, 14 are provided to produce the necessary clamping effect required to hold the associated portion 2 or 3 in its respective nest 12. If the nest 12 is designed to be outwardly, or upwardly, conically tapered, such special holding means are not necessary. Special holding means are also unnecessary if the tape-like foil 11 is composed of a plurality of layers, for example, when rolled into a roll, so that the foil portion constituting one turn of such roll can hold the fittings 2, 3 in the respective underlying foil turn.

Instead of the tabs 14, the foil 11 may be provided with a shaped-on tongue in the area of each nest 12 which tongue covers the portion 2 or 3 and thus holds it in the guide strip 1. It is also possible to attach the portion 2 or 3 to the bottom 15 of each nest by means of an adhesive, which, in the extreme case, permits each nest 12 to merely be in the form of a location marking on the foil 11.

At the side of the strip 1 from which the nests 12 project, the foil 11 is provided with spacers 16 at selected intervals, the spacers being arranged perpendicularly to the plane of the foil. In the illustrated embodiment, a respective spacer 16 is disposed between the nests 12 of each pair for the portions 2 and 3 of a given catch assembly. Each spacer 16 has the shape of a hollow protrusion in the form of a truncated pyramid. Other spacer configurations are possible. For example, spacers can be arranged in pairs along the edges of the foil.

In order to fasten the portions 2 and 3 to a box-shaped container, such as a piece of luggage, they are provided at their end faces, which extend in the direction of the length of strip 1, with pointed tacking prongs 21 and 31, respectively. The tacking prongs 21 and 31 are each enclosed in a clamping manner by two tabs 14 so that a form-locking connection is produced between the each portion 2 or 3, on the one hand, and the nests 12 of the guide strip 1, on the other hand.

The portion 2 of each catch is provided with a pivotal flap, or latch, 22, and after attachment of portions 2 and 3 at the desired location to a box-like container, flap 22 can pivot against recess portion 3 and thus locks the container.

The spacers 16 permit winding the guide strip 1 into a roll without the tacking prongs 21 and 31 catching on one another or scratching other portions 2 and 3. The spacers 16 in each instance support the following layer of the roll. The spacers 16 can at the same time be used for engagement with an advancing, delaying and/or aligning device in the studding machine (not shown). Instead of or in addition to the spacers 16, it is also possible to provide deformations, such as tabs or holes, in the foil for this purpose.

The foil 11 can be made of cardboard, metal or plastic, and polyvinyl chloride is a preferred material. With such a foil, the nests 12, spacers 16 and/or further deformations can be produced in the foil by a deep drawing process.

If, when being shaped to accommodate certain fittings, the foil material must not fall below a minimum thickness, it may be advantageous to provide holes, or openings, 17 in the bottom 15 of each nest 12.

When the strip advances through a studding machine, the tools of the studding machine pass through these holes 17 and press the portions 2 and 3 out of the nests 12. Then the tacking prongs 21 and 31 of a portion 2 and a portion 3 are hammered into the box-shaped container. If the foil 11 is flexible enough, such holes 17 need not be provided. In that case, the studding tool presses onto the bottom 15 fron the outside and thus releases a portion 2 and a portion 3 from their nests 12.

After its passage through the studding machine, the guide strip 1, no longer containing any catch portions 2 and 3, can be rolled up again and is then available to be loaded with a new array of fittings. The arrangement according to the invention permits the guide strip to be loaded and the studding process to be performed without any danger of accident to operating personnel. Any desired fittings can be hammered into box-shaped containers with the aid of the guide strip 1 according to the invention, particularly also for one-piece closures and hinges. The foil 11 is produced in a manner to give nests 12 the configurations required for the particular fitting to be employed.

Figure 4:
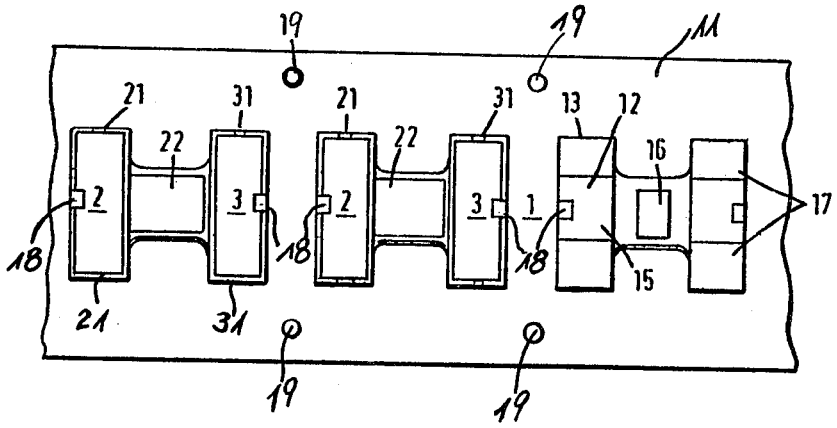
FIG. 4 is a bottom plan view of another embodiment of the invention.

FIG. 4 shows an embodiment similar to that in FIGS. 1–3; but with tongues 18 instead of the tabs 14, provided to produce the clamping effect required to hold the associated portion 2 or 3 in its respective nest 12. Each tongue 18 partly covers the respective portion 2 or 3. In FIG. 4 there are provided holes 19 in the foil 11 at spaced intervals for the engagement of a movement control device of the studding machine. The holes 19 could be provided in the embodiment of FIGS. 1–3 too. Instead of the holes other deformations in the foil 11 could be provided.

One studding machine which can accept a guide strip according to the invention is the "Automatic Hingefastening Press" Types VAP 5 V or SAP 5 of Schmale & Co., 5880 Lüdenscheid, Federal Republic of Germany.

It will be understood that the above description of the present invention is susceptible to various modifications, changes and adaptations, and the same are intended to be comprehended within the meaning and range of equivalents of the appended claims.

What is claimed is:

1. An assembly comprising a guide strip and a plurality of fittings carried by said strip, said assembly being provided for introduction into a studding machine in which each said fitting is separated from said strip and hammered into a box-shaped container, said guide strip comprising a tape-like foil presenting a succession of integral, conically tapered nests, each configured to conform to and retain a respective fitting, with said nests being spaced along said strip and all open to one face of said foil, and each said fitting being configured to be hammered into such a container and being releasably retained in a respective nest until being separated from said strip, and wherein each said nest includes holding means including a tongue disposed for holding a portion of the respective fitting in said nest.

2. An assembly as defined in claim 1 wherein said holding means for each said nest include an adhesive located at the bottom of said nest for attaching the respective fitting.

3. An assembly as defined in claim 1 wherein said foil is of plastic and said nests are formed in said foil by a deep drawing operation.

4. An assembly as defined in claim 1 wherein said foil is provided at spaced intervals with deformations for the engagement of a movement control device of the studding machine.

5. An assembly as defined in claim 4 wherein said foil is of plastic and said nests and deformations are formed in said foil by a deep drawing operation.

6. An assembly as defined in claim 1 wherein each said fitting comprises two portions and each said nest is configured to conform to and retain both portions of a respective fitting.

7. An assembly as defined in claim 6 wherein each said portion of each said fitting comprises tacking prongs via which each said fitting may be fastened into such a box-like container.

8. An assembly comprising a guide strip and a plurality of fittings carried by said strip, said assembly being provided for introduction into a studding machine in which each said fitting is separated from said strip and hammered into a box-shaped container, said guide strip comprising a tape-like foil presenting a succession of integral nests, each provided with openings in its bottom and each configured to conform to and retain a respective fitting, with said nests being spaced along said strip and all open to one face of said foil, and each said fitting being configured to be hammered into such a container and being releasably retained in a respective nest until being separated from said strip.

9. An assembly comprising a guide strip and a plurality of fittings carried by said strip, said assembly being provided for introduction into a studding machine in which each said fitting is separated from said strip and hammered into a box-shaped container, said guide strip comprising a tape-like foil presenting a succession of integral nests, each configured to conform to and retain a respective fitting, with said nests being spaced along said strip and all open to one face of said foil, and each said fitting being configured to be hammered into such a container and being releasably retained in a respective nest until being separated from said strip, wherein said strip further comprises spacers extending perpendicularly to the plane formed by said foil and from the other face of said foil.

10. An assembly as defined in claim 9 wherein said spacers are constituted by hollow protrusions having the form of truncated pyramids and extending from the same side of said foil as said nests.

11. An assembly as defined in claim 9 wherein said foil is of plastic and said nests and spacers are formed in said foil by a deep drawing operation.

* * * * *